US009865415B2

(12) United States Patent
Mittelstadt

(10) Patent No.: US 9,865,415 B2
(45) Date of Patent: Jan. 9, 2018

(54) TWO PIECE HANDLE FOR MINIATURE CIRCUIT BREAKERS

(71) Applicant: SCHNEIDER ELECTRIC USA, INC., Schaumburg, IL (US)

(72) Inventor: Chad R. Mittelstadt, Cedar Rapids, IA (US)

(73) Assignee: SCHNEIDER ELECTRIC USA, INC., Andover, MA (US)

( * ) Notice: Subject to any disclaimer, the term of this patent is extended or adjusted under 35 U.S.C. 154(b) by 0 days.

(21) Appl. No.: 15/101,954

(22) PCT Filed: Dec. 27, 2013

(86) PCT No.: PCT/US2013/078019
§ 371 (c)(1),
(2) Date: Jun. 6, 2016

(87) PCT Pub. No.: WO2015/099771
PCT Pub. Date: Jul. 2, 2015

(65) Prior Publication Data
US 2016/0307715 A1 Oct. 20, 2016

(51) Int. Cl.
*H01H 21/22* (2006.01)
*H01H 71/52* (2006.01)
*H01H 71/02* (2006.01)

(52) U.S. Cl.
CPC ..... *H01H 21/22* (2013.01); *H01H 71/521* (2013.01); *H01H 71/0207* (2013.01); *H01H 71/524* (2013.01)

(58) Field of Classification Search
CPC .... H01H 21/22; H01H 71/524; H01H 71/521; H01H 71/0207
(Continued)

(56) References Cited

U.S. PATENT DOCUMENTS 4,916,420 A 4/1990 Bartolo et al.
5,245,302 A 9/1993 Brune et al.
(Continued)

FOREIGN PATENT DOCUMENTS

DE 60201210 T2 11/2005
DE 60201775 T2 12/2005
EP 1255270 B1 9/2004

OTHER PUBLICATIONS

International Search Report and Written Opinion dated May 6, 2014 in PCT/US2013/078019, 12pp.

*Primary Examiner* — Edwin A. Leon
(74) *Attorney, Agent, or Firm* — Locke Lord LLP

(57) ABSTRACT

A miniature circuit breaker 10 having a handle assembly 100 formed of two separate pieces, namely a handle section 110 and a link section 150 with a first end 152 and a second end 154. The link section 150 is pivotally connected at the first end 152 to the handle section 110, and at the second end 154 to a movable blade 30 carrying the movable contact 32 of the circuit breaker. The handle section 110 can be formed of a plastic, and the link section 150 can be formed of a metallic material. A metallic link section can be thinner than an equivalent plastic part, and can provide a robust metal-to-metal interface with the blade 30 carrying the movable contact 32. The handle assembly 100 can also have one or more clearance gaps 132 and 134 designed between the handle section 110 and link section 150 to provide for a range of independent motion by the handle section 110 in relation to the link section 150.

14 Claims, 5 Drawing Sheets

(58) Field of Classification Search
USPC ..... 200/337, 400, 401, 288, 50.19, 50.02, 200/410, 411, 430, 431, 428, 440–442, 200/318, 321, 324, 325, 327, 335, 6 R
See application file for complete search history.

(56) References Cited

U.S. PATENT DOCUMENTS

| | | | | |
|---|---|---|---|---|
| 7,115,829 | B2 | 10/2006 | Schmid | |
| 7,368,677 | B2 * | 5/2008 | Jones | H01H 3/3031 200/400 |
| 7,449,653 | B2 * | 11/2008 | Gibson | H01H 3/3015 200/318 |
| 7,459,650 | B2 * | 12/2008 | Weister | H01H 71/505 200/400 |
| 7,495,189 | B2 | 2/2009 | Christmann et al. | |
| 8,058,580 | B2 | 11/2011 | Gottschalk et al. | |
| 8,604,374 | B2 | 12/2013 | Mittelstadt | |
| 2005/0269195 | A1 | 12/2005 | Brandon et al. | |

* cited by examiner

TWO PIECE HANDLE FOR MINIATURE CIRCUIT BREAKERS

FIELD

The present disclosure relates to a multi-piece handle assembly for a circuit breaker, particularly for a miniature circuit breaker (MCB).

BACKGROUND

A circuit breaker is an overcurrent protective device that is used for circuit protection and isolation. The circuit breaker provides electrical system protection when a designated electrical abnormality such as an overcurrent or overload event occurs in the system. One type of circuit breaker is a miniature circuit breaker (MCB), which is typically used for low voltage applications. An MCB typically includes a base and cover, and an electrical circuit between a line terminal and a load terminal. The electrical circuit includes a conductive stationary contact electrically connected to one of the terminals and a movable contact electrically connected to the other terminal. The movable contact is secured on a movable blade (also referred to as a contact carrier). A handle assembly, in the form of a single piece handle, interfaces with the blade and the trip lever of the trip mechanism as further explained below. The handle assembly can be operated by a user to move the blade, and thus the movable contact, between an open position and a closed position to open or close the electrical circuit. In the closed position, the movable contact is engaged with the stationary contact to allow current flow between the two contacts to a protected load. In the open position, the movable contact is disengaged from the stationary contact to prevent or interrupt current flow to the protected load.

The MCB also includes a trip mechanism. The trip mechanism controls a trip lever, which is connected to the blade via a tension spring (also known as a "toggle spring"). When an abnormal operating condition is detected (e.g., an over current or over temperature fault), the trip mechanism implements a trip operation to disengage the movable contact from the stationary contact by releasing or unlatching the trip lever, which in turn interrupts current flow to the protected load at another open position generally referred to as the tripped position. Thereafter, the circuit breaker can be reset to an intermediate or reset position, and then returned to an open position. Once in the open position, the user can move the breaker back to the closed position via the handle assembly.

A miniature circuit breaker is subject to size constraints. As a consequence, there is very little space to arrange and fit the numerous moving parts of the breaker in the cover and base, thereby creating design restrictions as to the size, shape, dimension and materials of the various parts of the breaker. For example, in one type of MCB, the single piece handle, which is directly interfaced to the movable blade, is constantly subjected to the force of the tension spring, and thus, is subject to greater wear from the operation of the circuit breaker (e.g., a circuit breaker is typically switched mechanically and electrically over 10,000 times to comply with testing requirements). The single piece handle is connected to the metallic movable blade, and thus, must have sufficient durability, strength and/or rigidity to provide a suitable plastic to metal interface between the handle and the blade. Therefore, the single piece handle must be constructed with a significant thickness using a rigid or strong non-conductive material, such as thermoset.

Furthermore, in certain types of MCBs, the top portion of the tension spring, which is connected to the trip lever, is designed without coils (e.g., a partially coiled tension spring) in order to avoid becoming entangled with a portion of the handle. The use of a partially coiled tension spring is inefficient and costly, since the coils must be designed to provide a greater force (to compensate for the non-coiled portion) than otherwise would be needed if a fully coiled tension spring is used. Furthermore, the thickness of the handle also impacts the design of the trip lever and other components such as the blade in an area in the MCB where potential interference between the parts may occur, e.g., an interference area.

Accordingly, there is a need for a practical and reliable solution for providing greater flexibility in the design and assembly of the various parts of a circuit breaker, particularly a MCB. There is also a need to improve upon the durability of the handle of an MCB.

SUMMARY

To address these and other shortcomings, the present disclosure provides a unique design for a handle assembly for a circuit breaker, specifically for a miniature circuit breaker (MCB). The handle assembly includes at least two separate pieces, namely a handle section operable by a user, and a link section which interconnects the handle portion and a movable blade with a contact (i.e., the movable contact). The link section may include a first end which is pivotally connected to the handle section, and a second end which is pivotally connected to the movable blade. The handle section can be formed of a non-conductive and/or non-metallic material, including a plastic material such as thermoset or a less rigid material such as thermoplastic. The link section can be formed of a metallic material such as a metal or metal alloy (e.g., steel).

The disclosed two piece handle assembly provides a number of benefits. For example, the link section can be formed of a ferromagnetic material, which can allow for magnetic hold down during circuit breaker assembly to provide an efficient, easy approach to assembling the circuit breaker. The link section, if formed of a metallic material (e.g., steel), can be thinner than the plastic equivalent part and therefore free up space in an area or location (e.g., a potential interference area) of the breaker where the handle assembly, movable blade, trip lever, and tension spring coexist. Thus, with more available space, there is reduced mechanical interference at that location and greater freedom for the design of the tension spring and the trip lever. Also, where the link section is steel and the movable contact is copper, the resultant steel-to-copper interface is more robust than the plastic-to-copper interface which results from the typical all-plastic handle.

A wedge type connection without mechanical fasteners (e.g., tab and slot, tab and notch, etc.) is typically employed in the known art for interaction between the handle and the blade with the movable contact, and between the handle and the trip lever. The handle assembly discussed herein can use a pin joint in place of a wedge connection. The pin joint is a more dimensionally controlled joint because it removes more degrees of freedom from the joint and controls the motion without the aid of the cover. The pin joint also prevents the blade from disengaging from the handle during extreme dynamic opening tests like HIC (high interrupting capacity) because of the more degrees of freedom it controls. Furthermore, the pin joint connection allows for a repeatable movable-contact open-close angular motion which does not rely on a breaker cover (also referred to as a "case") to hold together the handle assembly and the blade with the movable contact.

The handle section, as a non-metallic (e.g., plastic) piece, can allow for modular circuit breaker design where different products such as tandem, one pole, two pole, thermal magnetic, electronic, ⅜ inch, ¾ inch, 1 inch, full-width, and half-width circuit breakers use the same link section but different handle sections. Thus, a variety of modular handle sections can be produced to improve assembly and manufacture of different circuit breakers using the same link section. Furthermore, allowing different products to share the same parts can lead to cost savings.

The handle assembly discussed herein can be implemented so that, when the movable contact is in the closed position, there is a clearance gap(s) between the handle section and the link section. This clearance gap provides the handle section with an independent range of motion in relation to the link section. For example, the pivotal range of motion (e.g., movement) of the handle section may be greater than that of the link section (e.g., 45 degrees for the handle section and 40 degrees for the link section). Thus, in contrast to the typical one piece, all-plastic handle in which a strong plastic (e.g., thermoset) must be used due to the stress from the constant force from the tension spring, the two piece handle assembly does not bear this stress but instead the link section bears this stress along with the cover. As such, the handle section can be made of a softer material (e.g., a thermoplastic), if desired.

Furthermore, the clearance gap yields other benefits including preventing the transference of push and/or twist of the handle section to the link section. Push and twist of the handle assembly are frequent occurrences because of user interaction with the handle assembly. The prevention of push and twist transference yields benefits including decreasing wear on the circuit breaker. A compliant material (e.g., rubber, foam, sponge or flexible metal) can also be placed at the interface between portions of the handle section and the link section to further decrease transference of push and/or twist, while preventing gravitational forces from allowing the handle section to hang freely or loosely and to rattle in light of the independent range of motion provided through the clearance gap.

The link section of the handle assembly is pivotally connected at a first end to the handle section of the handle assembly, and pivotally connected to the blade with the movable contact at a second end via a mechanical fastener. Movement of the handle section in a first direction causes the handle assembly to move the blade, via the link section, to a closed position where the movable contact engages the stationary contact. Movement of the handle in a second direction (e.g., opposite the first direction) causes the handle assembly to move the blade, via the link section, to an open position where the movable contact is disengaged from the stationary contact. The trip lever is connected to the blade with the movable contact via spring biasing means, such as a tension spring and is also moved to the reset by the handle section shoulders, i.e., angular surfaces 142, of the handle section. In response to a trip condition such as an abnormal operating condition (e.g., an overcurrent or a short circuit), the circuit breaker is tripped, i.e., the trip lever is released or unlatched from a latched position via a trip lever actuator assembly (e.g., an assembly including a yoke, bimetal and armature). The unlatched trip lever, which is biased by the tension spring, pulls the blade away from the stationary contact into a tripped position in which the movable contact is disengaged from the stationary contact. As a result, the flow of current to a protected load is interrupted.

In this manner, the present disclosure provides a practical and reliable solution for implementing a circuit breaker.

BRIEF DESCRIPTION OF THE DRAWINGS

The description of the various exemplary embodiments is explained in conjunction with the appended drawings, in which.

DETAILED DESCRIPTION

By way of general discussion, a miniature circuit breaker (MCB) of the type discussed herein may generally have a dielectric cover and base with interior compartments or recesses containing, for example, a conductive stationary contact, a conductive blade (also referred to as a contact carrier) with a conductive movable contact, an arcing chamber, and a handle assembly. The MCB also includes a trip mechanism, such as a trip lever, a tension spring and a trip lever actuator assembly (e.g., yoke, armature and bimetal). The handle assembly of the MCB is connected to the blade to give the operator the ability to turn the circuit breaker ON (in the closed position) to energize a protected circuit or OFF (in the open position) to disconnect the protected circuit, or to reset the circuit breaker after it trips to protect the circuit. A conductive line-side terminal and load-side terminal will extend through the cover for connecting the circuit breaker to the intended electrical conductors. A general description and illustration of these known parts of a miniature circuit breaker as a whole can be found in U.S. Pat. No. 5,245,302 for the edification of the reader should such be needed, but will not be further discussed in particular detail herein. A unique handle assembly design for a circuit breaker, particularly an miniature circuit breaker, will be described below with reference to FIGS. 1 through 8, in accordance with the present disclosure.

Figure 1:
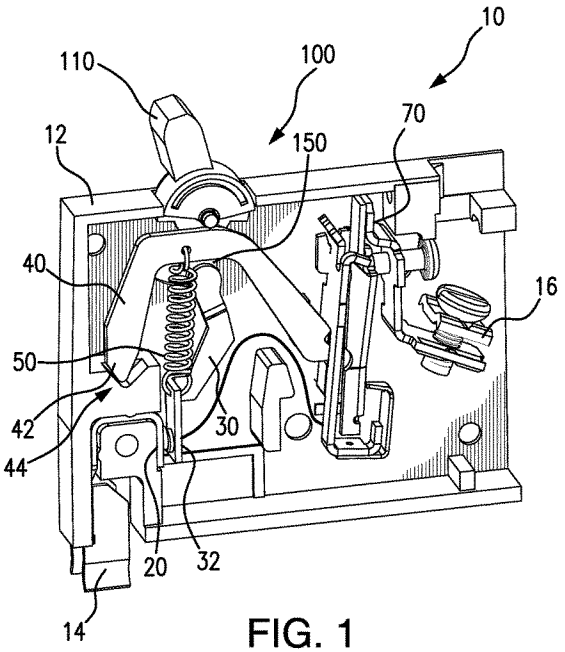
FIG. 1 illustrates a side view of a circuit breaker, such as a miniature circuit breaker, with one side removed to show the internal parts in a closed position or ON state, in accordance with an exemplary embodiment of the present disclosure.
Figure 2:
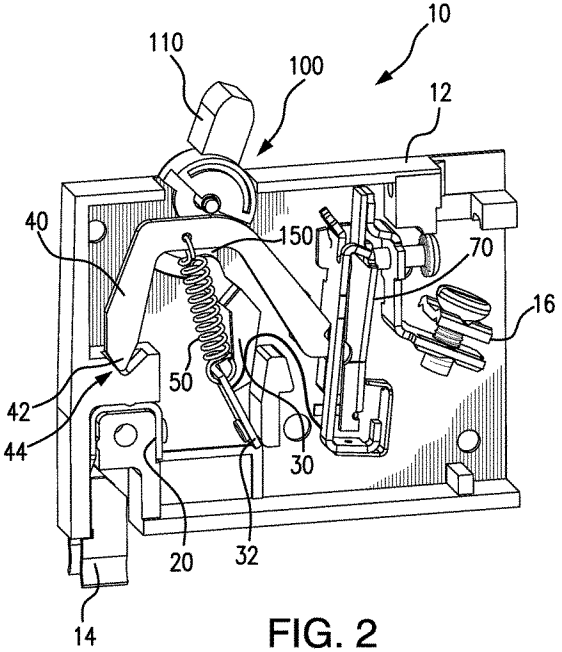
FIG. 2 illustrates a side view of the circuit breaker of FIG. 1 with one side removed to show the internal parts in an open position or OFF state.

FIG. 1 shows a side view of a miniature circuit breaker 10 with one side of its cover removed to show some of the components thereof. The circuit breaker 10 includes a cover and base (together referred to as cover 12) having compartments and recesses for retaining components of the breaker. The components of the circuit breaker 10 include a first terminal 14 electrically connected to a stationary contact 20, a second terminal 16 electrically connected to a blade 30 with a movable contact 32, and a handle assembly 100. The first terminal 14 can be a line terminal connected to a power line, and the second terminal can be a load terminal connected to a protected load on a branch circuit. The handle assembly 100 is connected to the blade 30. In this example, the handle assembly 100 is pivotally connected via mechanical fasteners to the blade 30, but may be movably connected through other types of connections (e.g., a wedge connection such as a tab and slot, a tab and notch, etc.). The handle assembly 100 can be operated by a user between an open position and a closed position. In the open position as shown in FIG. 2, the movable contact 32 is disengaged from the stationary contact 20 to prevent the flow of current to the protected load connected to the second terminal 16. As shown in FIG. 1, in the closed position, the movable contact 32 is engaged to the stationary contact 20 to allow the flow of current from the power line connected to the first terminal 14 to the protected load.

The circuit breaker 10 further includes a trip mechanism for interrupting power to a protected device in the event of a trip condition. The trip mechanism of the circuit breaker 10 can include a trip lever 40, a spring biasing means such as a tension spring 50, and a trip lever actuator assembly 70 with thermal trip capability (e.g., for persistent low level overcurrents) and/or magnetic trip capability (e.g., for higher overload currents). The trip lever actuator assembly 70 may employ known components, such as a yoke and armature for magnetic trip capability and, in addition, a bimetal (along with the yoke and armature) for thermal trip capability. For magnetic tripping in response to sudden overloads, a magnetic field induced relative to the magnetic yoke causes the armature to be moved relative to the yoke, which in turn triggers a magnetic trip to release the trip lever 40. For thermal tripping, the bimetal moves in response to excessive electrical current and causes the armature to move relative to the yoke, thereby triggering a chain of mechanical actions that cause the breaker to Cher tally trip and release the trip lever.

The trip lever 40 is connected to the blade 30, via the tension spring 50, which applies a constant force on the blade 30 in the latched (or un-tripped) position of FIG. 1. The tension spring 50 may have hooks on its ends which engage respective holes in the trip lever 40 and the blade 30. When a trip condition occurs, the trip lever 40 is released or unlatched by the trip lever actuator assembly 70 to the tripped position (e.g., a wedge-type end portion 42 of the trip lever 40 pivots in a V-shaped groove 44 to the tripped position). In the tripped position, the trip lever 40 and the tension spring 50 together pull the blade 30 and the movable contact away from the stationary contact 20. As a result, the movable contact 32 is disengaged from the stationary contact 20, and the flow of current to the protected load is interrupted. The circuit breaker 10 can be reset to a reset position, via the handle assembly 100, and then placed into the open position (as shown in FIG. 2). Thereafter, the user can operate the handle assembly 100 and place the circuit breaker 10 back into the closed position (as shown in FIG. 1).

The handle assembly 100 of the circuit breaker 10, as discussed herein, is a multi-piece assembly formed of a combination of non-metallic and metallic pieces. For example, the handle assembly 100 includes two pieces, such as a handle section 110 and a link section 150 for interconnecting the handle section 110 with the blade 30. The handle section 110 is formed of a non-metallic and non-conductive material, and is operable by a user. The link section 150 is formed of a metallic material, such as a metal or metal alloy (e.g., steel, stainless steel, etc.). To facilitate magnetic hold down of circuit breaker components during assembly, the link section 150 can be formed of a ferromagnetic material.

Figure 3:
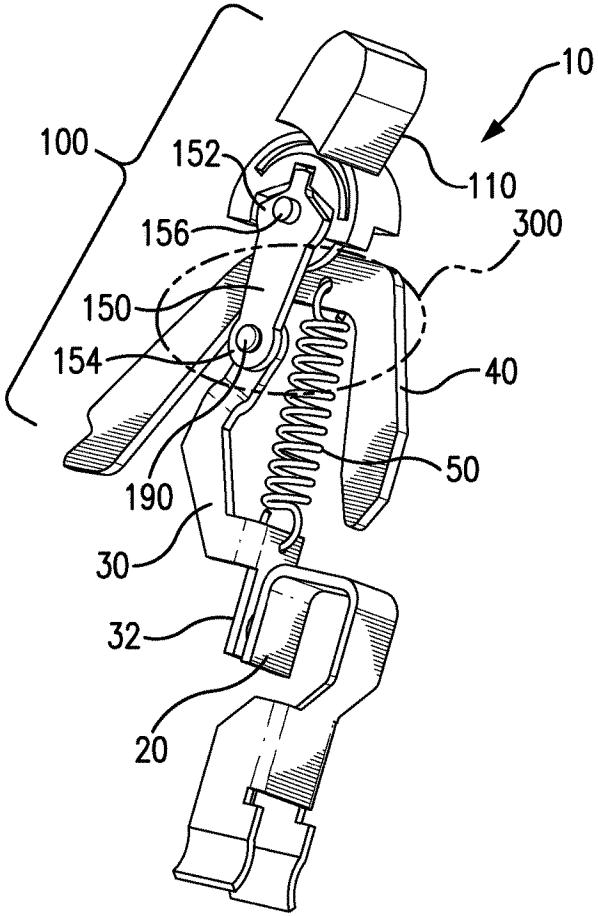
FIG. 3 illustrates an enlarged perspective view of certain components of the circuit breaker of FIG. 1, including a handle assembly, a blade with the movable contact, a stationary contact, a trip lever and a tension spring, in the closed position.

As shown in FIG. 3, the link section 150 includes a first end 152 and a second end 154. The first end 152 of the link section 150 includes a pin 156, which extends outwards from both sides of the first end 152. The first end 152 is pivotally connected to the handle section 110, via the pin 156, which forms a pin joint. For example, one end of the pin 156 extends through an opening (not shown) in the handle section 110 and can engage a groove or opening on one side of the cover 12 (not shown). The opposite end of the pin 156 can engage a groove or opening on the other side of the cover 12 (not shown). The second end 154 of the link section 150 is pivotally connected to the blade 30, via a mechanical fastener such as a pin 190, which also forms a pin joint. The pin 190 is movably engaged in an opening (not shown) in the second end 154 of the link section 150. Unlike the use of conventional wedge-type connections, the use of a pin joint (e.g., via pin 190) provide a secure connection between at least the link section 150 and the blade 30, without the need for the cover 12 to hold these parts together. Thus, the handle assembly 100 can be operated in a repeatable movable-contact open-close angular motion without relying on the cover 12 to hold the link section 150 and the blade 30 together.

Figure 4:
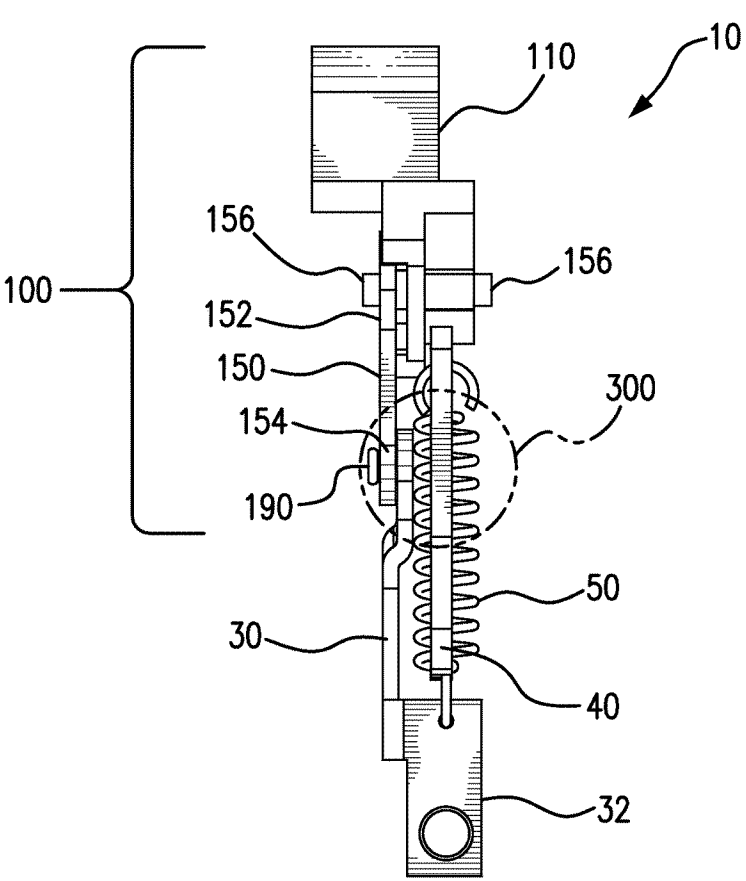
FIG. 4 illustrates another enlarged view from one end of the circuit breaker of certain components of the circuit breaker of FIG. 1, including a half size handle assembly, the blade with the movable contact, the stationary contact, the trip lever and the tension spring.

FIG. 4 illustrates an end view of certain components of the circuit breaker 10, including the stationary contact 20, the blade 30 with the movable contact 32, the trip lever 40, the tension spring 50, the handle section 110 and the link section 150. As shown in FIG. 4, there is limited space to arrange movable components of the circuit breaker 10, such as identified by a potential interference area 300 (also shown in FIG. 3). For example, the link section 150 is arranged with one side adjacent to a portion of the trip lever 40 and a portion of the tension spring 50, in the closed position. The ability to employ a thinner profile with a metallic link section 150 (versus traditional one-piece plastic handle) opens up the potential interference area 300, and allows for increased flexibility in the design of the movable components or parts of the circuit breaker 10, particularly in an MCB. For example, the size, shape, dimension and configuration of the blade 30, the trip lever 40 and the tension spring 50 can be modified as more space becomes available through the use of a thin metallic link section 150. For instance, a fully coiled tension spring 50 might be used instead of a partially coiled tension spring, in the circuit breaker 10 configuration as shown in FIGS. 3 and 4. The tension spring 50 can be fully coiled along a length of the tension spring 50 between its connections to the trip lever 40 and the movable blade 30, such as for example inside a 0.375 inch mechanism with the handle assembly to blade connection below the tension spring to trip lever connection.

Figure 6:
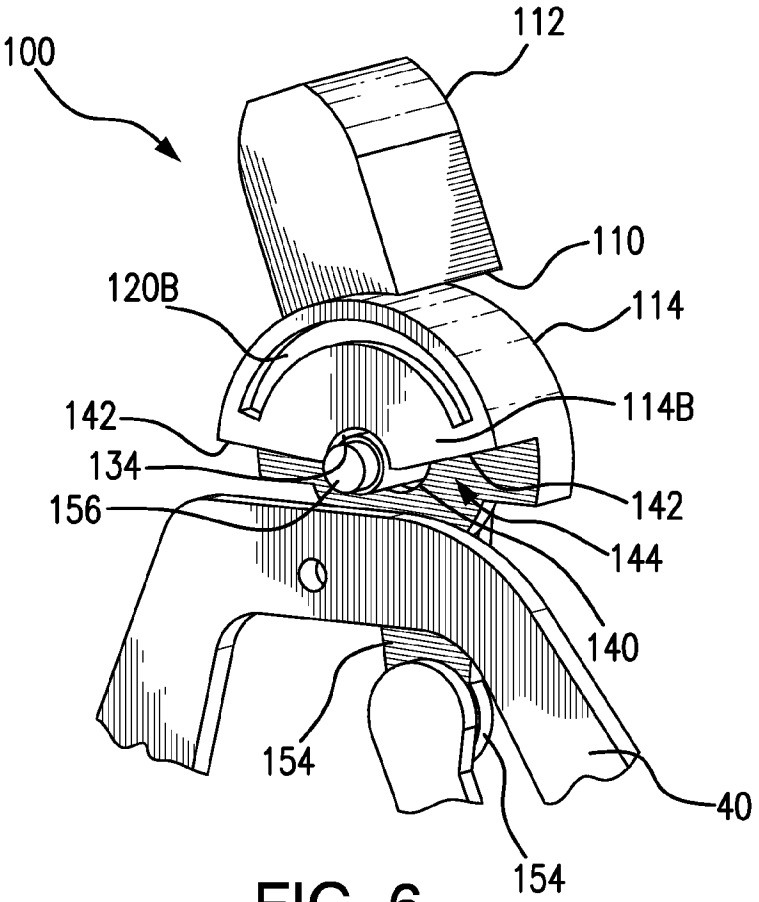
FIG. 6 illustrates an enlarged side view of another side of the handle assembly of FIG. 4.
Figure 5:
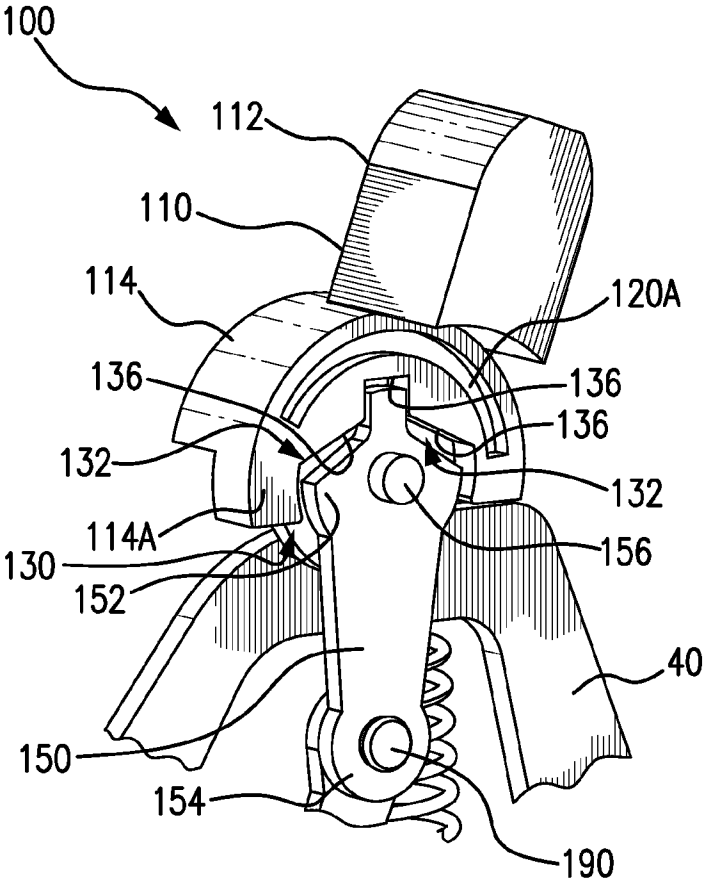
FIG. 5 illustrates an enlarged side view of one side of the handle assembly of FIG. 4.

FIGS. 5 and 6 illustrate enlarged views of opposite sides of the handle assembly 100 and its handle section 110 and link section 150. As shown in FIGS. 5 and 6, the handle section 110 includes a top portion 112 and a bottom portion 114. The top portion 112 has a knob shape, which is operable by the user. The bottom portion 114 has an arc-shaped body, which is movably engaged to the cover 12. The bottom portion 114 has two sides, namely a first side 114A (shown in FIG. 5) and a second side 114B (shown in FIG. 6).

Figure 7:
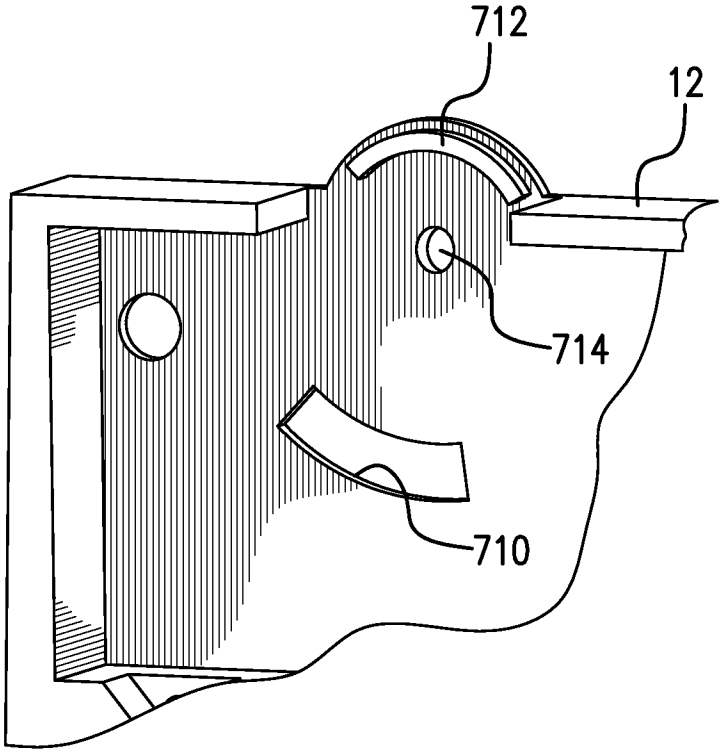
FIG. 7 illustrates a partial view of an interior of one side of a cover of the circuit breaker of FIG. 1, where the handle assembly is retained.
Figure 9:
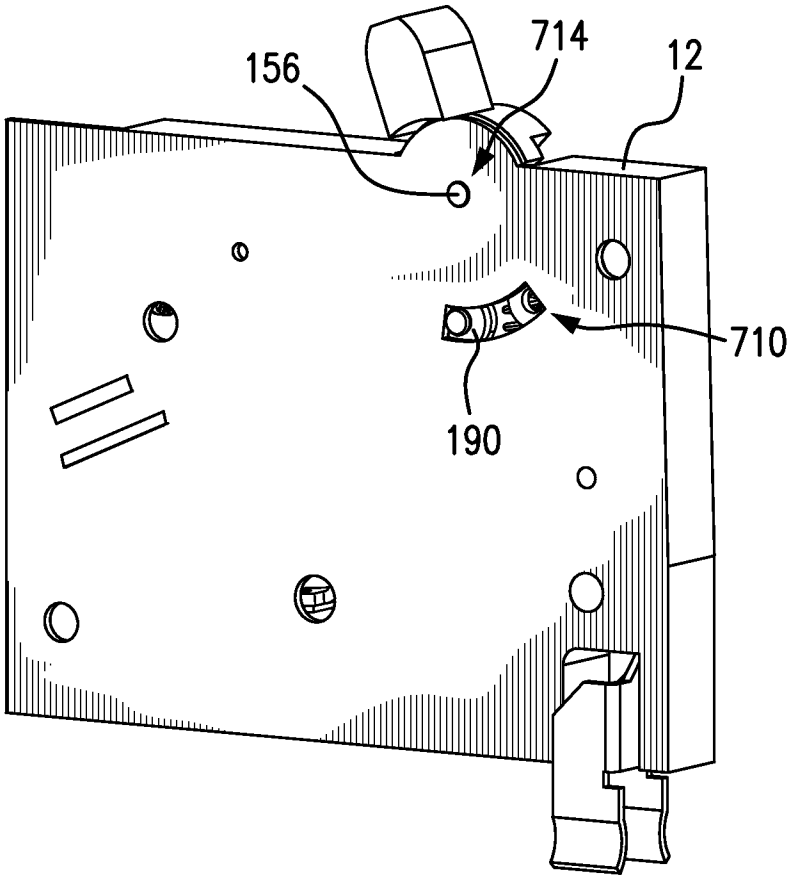
FIG. 9 illustrates an external view of the side of the cover in FIG. 7, with a portion of the pin joint, which connects the blade and the link section together, engaged in a slot in the cover.

The first side 114A includes an arc shaped groove and stop 120A and a recessed portion 130. The groove and stop 120A is used to control the pivotal motion and range of the handle section 110 in the cover 12 of the circuit breaker 10. The recessed portion 130 has a shape and dimension configured to receive the first end 152 of the link section 150, and an opening 140 (shown in FIG. 6 from the other side 114B) to receive a portion of the pin 156 of the link section therethrough. The first side 114A of the handle section 110 can engage an interior portion of the cover 12, such as shown in FIG. 7. In this example, one end of the pin 156 is engaged in a groove or opening 714 in the cover 12 to help bear the tension spring force. A first protrusion 712 (e.g., a pin, tab, etc.) is engaged in a groove of the groove and stop 120A. In this example, the first protrusion has an arc-shape. Furthermore, the pin 190, which is engaged through the second end 154 of the link section, extends into a slot 710 (including stops), which controls the pivotal motion and range thereof of the second end 154 pivotally connected to the blade 30. FIG. 9 shows another view of the pin 190 engaged in the slot 710 of the cover 12, and the pin 156 engaged in the groove or opening 714 of the cover 12.

Figure 8:
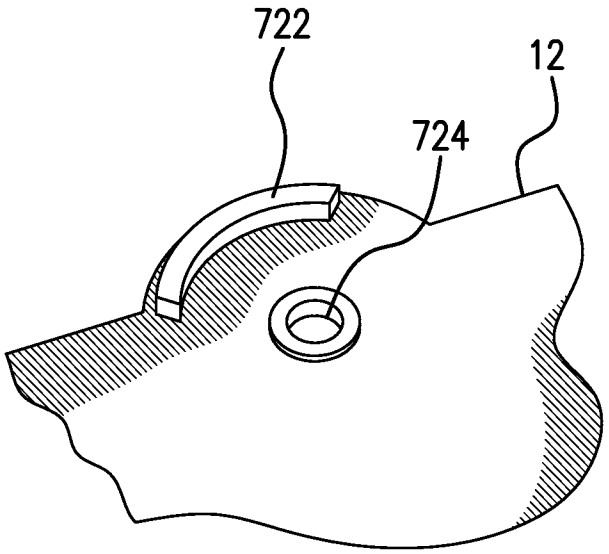
FIG. 8 illustrates a partial view of an interior of the opposite side of the cover of FIG. 5, where the handle assembly is retained.

As shown in FIG. 6, the second side 114B of the handle section 110 also includes a groove and stop 120B (such as the groove and stop 120A on the opposite side 114A). The groove and stop 120B likewise is used to control the pivotal motion and range thereof of the handle section 110 in the cover 12 of the circuit breaker 10. An end of the pin 156 of the link section extends through the opening 140, and provides a pin joint between the first end 152 of the link section 150 and the bottom portion 114 of the handle section 110. The second side 114B of the handle section 110 can engage an interior portion of the cover 12, such as shown in FIG. 8. In this example, another end of the pin 156 is engaged in a groove or opening 724 in the cover 12. A second protrusion 722 (e.g., a pin, tab, etc.) is engaged in the groove of the groove and stop 120B. In this example, the second protrusion 722 has an arc-shape.

Turning back to FIG. 6, the second side 114B includes a recessed area 144 defined by angular surfaces 142 (e.g., walls), which are arranged adjacent to the top portion of the trip lever 40. When the trip lever 40 is in the tripped position, the top portion of the trip lever 40 contacts the angular surfaces 142 and moves the handle assembly 100, including the top portion 112, to a middle position reflecting a tripped state (e.g., between a position of the top portion 112 which indicates the open position and the closed position). The user can operate the handle assembly 100 to move the trip lever 40 and to re-latch or re-connect the trip lever 40 to the trip lever actuator assembly 70 (shown in FIGS. 1 and 2) in the reset position (not shown) (e.g., a position of the top portion 112 farthest away from the one which indicates the closed position). Thereafter, the user can operate the handle assembly 100 to place the circuit breaker 10 in the open position (in FIG. 2) and afterwards back to the closed position (in FIG. 1).

The handle section 110 is connected to the link section 150 in a manner which provides the handle section 110 with an independent range of motion (e.g., a free range of motion). In accordance with an exemplary embodiment, the shape and dimension of the handle section 110 and the link section 150 are designed to provide for clearance gaps therebetween when movably connected together. For example, as shown in FIG. 5, the recessed portion 130 of the bottom portion 114 of the handle section 110 has a shape and dimension, which provides for a clearance gap(s) 132 between surfaces 136 (e.g., stops or stop surfaces) of the bottom portion 114 and the first end 152 of the link section 150, when connected to each other. In this way, the handle section 110 has an independent range of motion defined by the clearance gap(s) 132. Furthermore, as shown in FIG. 6, a clearance gap(s) 134 is also provided between the pin 156 of the link section 150 and the inner surface of the bottom portion 114 defining the opening 140 and the surrounding areas. The size, shape and dimension of the clearance gap(s) 132 and 134 can be configured to control an amount of independent motion or range of motion by the handle section 110 in relation to the link section 150 when engaged thereto. In this way, the pivotal range of motion by the handle section 110 can have a greater range of pivotal motion than the link section 150 (e.g., 45 degree range of motion for the handle section 110, and 40 degree range of motion for the link section 150).

By providing clearance gaps, the handle section 110 is not subjected to the constant force of the tension spring in the closed or open position, because the mechanical fastener, e.g., the pin 156, on the first end 152 of the link section 150 is engaged to (e.g., anchored in) the cover 12 which absorbs the force of the tension spring. Therefore, the force of the tension spring (e.g., the spring load) is primarily carried by the metallic piece of the handle assembly 100, namely the link section 150, and he cover 12 (e.g., a case) which has the pin 156 anchored thereto. Thus, the clearance gap(s) minimizes transference of a force from the tension spring 50 onto the handle section 110. The clearance gap(s) 132 and 134 isolate and thus minimize transference of push and twist forces and small motions from the handle section 110 to the link section 150. Accordingly, the handle section 110 is subject to less wear resulting from the operation of the circuit breaker 10. The handle section 110 can thus be formed of a softer material or plastic, such as thermoplastic. Furthermore, the handle section 110 can be molded as a single or unitary piece.

A compliant material (e.g., rubber, foam, sponge or flexible metal) can be placed at the interface between the handle section 110 and the link section 150 to act as a flexible coupler. The compliant material can decrease transference of push and/or twist from the handle section 110 to the link section 150, while preventing gravitational forces from allowing the handle section 110 to hang freely or loosely and to rattle in view of the independent range of motion provided through the clearance gaps 132 and 134. For example, a foam or rubber washer can be placed in the recessed portion 130 between the first end 152 of the link section 150 and the bottom portion 114 of the handle section 110.

The disclosed embodiments of the components of the circuit breaker 10, including the cover, the handle section and the link section, are provided as examples. Although the example of the handle section is discussed above with arc-shaped grooves and respective protrusions (e.g., tab or pin) which define a range of pivotal motion of the handle section in relation to the cover, the grooves and protrusions can be provided on either the handle section or the cover and formed in different sizes, shapes and dimensions. In addition the pins may be integrally formed with the components (e.g., the blade and the link section), or formed separately and connected to and through suitable openings in the components of the circuit breaker.

In an alternative embodiment, one end of the pin (e.g., the pin 156) of the link section is engaged to a groove or opening in a first side of the cover, and an opposite end of the pin may engage a groove or slot in the handle section (instead of extending through an opening, e.g., the opening 140, in the handle section). The handle section may include its own pin which extends from one side thereof to engage an opening or groove in a second side of the cover opposite the first side.

Furthermore, the handle section and the link section can be formed into any suitable size, shape and dimension to provide clearance gap(s) between the handle section and the link section when movably connected to each other. Also, the link section can be formed of steel, and the blade with the movable contact can be formed of copper. The resultant steel-to-copper interface can provide a more robust connection interface than the plastic-to-copper interface which results from the typical all-plastic handle.

In addition, the handle assembly, with a direct mechanical link to the blade, is strong enough that it operate the blade and the trip lever of a variety of breaker sizes, which can allow for modular circuit breaker design where different products such as tandem, one pole, two pole, thermal magnetic, electronic, ⅜ inch, ¾ inch, 1 inch, full-width, and half-width circuit breakers use the same link section but different handle sections. A full-width circuit breaker has a full width handle, and a half-width circuit breaker has a half width handle. The handle section, as a moldable plastic piece, thus can have a variety of modular handle sections produced to improve assembly and manufacture of different types of circuit breakers using the same link section (as discussed herein). Furthermore, allowing different products to share the same parts can lead to cost savings.

Further, instead of a slot 710 (as shown in FIGS. 7 and 9), a race or channel can be used to control the motion of the link section 150. The race may use a portion of the base wall thickness of the cover 12. Also, instead of using a V-shaped pivot configuration (e.g., wedge-type end portion 42 of the trip lever 40 and V-shaped groove 44 in FIGS. 1 and 2), a pivot pin can be used to control the motion of the trip lever 40.

While particular embodiments and applications of the present disclosure have been illustrated and described, it is to be understood that the present disclosure is not limited to the precise construction and compositions disclosed herein and that various modifications, changes, and variations can be apparent from the foregoing descriptions without departing from the spirit and scope of the invention as defined in the appended claims.

The invention claimed is:

1. A circuit breaker, comprising:

a stationary contact;

a movable blade having a movable contact;

a two-piece handle assembly connected to the movable blade, the handle assembly being operable in a first direction to engage the movable contact to the stationary contact in a closed position and operable in a second direction to disengage the movable contact from the stationary contact in an open position, the handle assembly including:

a handle section operable by a user, and a separate link section with a first end and a second end, the link section being pivotally connected to the handle section at the first end and pivotally connected to the movable blade at the second end; and a trip lever connected to the movable blade across a tension spring, the trip lever configured to disengage the movable contact from the stationary contact in response to a trip condition.

2. The circuit breaker of claim 1, wherein the second end of the link section is pivotally connected to the blade via a mechanical fastener.

3. The circuit breaker of claim 1, wherein the first end of the link section is pivotally connected to the handle section via a mechanical fastener.

4. The circuit breaker of claim 3, wherein the mechanical fastener is anchored to a case of the circuit breaker.

5. The circuit breaker of claim 1, wherein the handle section has a greater pivotal range of motion than the link section.

6. The circuit breaker of claim 1, wherein the handle section includes a recessed portion for receiving the first end of the link section and providing a clearance gap between the handle section and the first end of the link when pivotally engaged together, the clearance gap defining an independent range of pivotal motion for the handle section in relation to the link section.

7. The circuit breaker of claim 6, wherein the clearance gap between the handle section and the link section isolates transference of push and twist forces from the handle section to the link section.

8. The circuit breaker of claim 1, wherein the handle section is formed of a non-metallic material.

9. The circuit breaker of claim 8, wherein the handle section is formed of thermoplastic.

10. The circuit breaker of claim 1, wherein the link section is formed of a metallic material.

11. The circuit breaker of claim 10, wherein the link section is formed of a ferromagnetic material.

12. The circuit breaker of claim 1, wherein a compliant material is situated between portions of the handle section and the link section.

13. The circuit breaker of claim 1, wherein one side of the link section is adjacent to a portion of the trip lever and a portion of the tension coil in the closed position.

14. The circuit breaker of claim 13, wherein the tension spring is fully coiled along a length of the tension spring between its connections to the trip lever and the movable blade.

* * * * *